United States Patent [19]

Ochs

[11] 4,006,671

[45] Feb. 8, 1977

[54] CORRUGATOR

[75] Inventor: Gordon M. Ochs, Washougal, Wash.

[73] Assignee: Tidland Corporation, Camas, Wash.

[22] Filed: Mar. 6, 1975

[21] Appl. No.: 555,792

[52] U.S. Cl. ..... 93/59 CE; 83/665; 93/58.1; 83/504

[51] Int. Cl.[2] ..... B26D 7/26

[58] Field of Search ..... 83/665, 498, 499, 504; 93/58.1, 58.2 R, 58.2 F, 59 CE, 58 R, 58.4

[56] References Cited

UNITED STATES PATENTS

| | | | |
|---|---|---|---|
| 3,059,552 | 10/1962 | Easter et al. | 93/58.2 R |
| 3,422,714 | 1/1969 | Van Gompel et al. | 83/665 X |
| 3,587,374 | 6/1971 | Stewart et al. | 93/58.2 R X |
| 3,742,714 | 7/1973 | Thomas | 83/665 X |
| 3,782,234 | 1/1974 | Rodach | 83/665 |

*Primary Examiner*—James F. Coan
*Attorney, Agent, or Firm*—Klarquist, Sparkman, Campbell, Leigh, Hall & Whinston

[57] ABSTRACT

A corrugator having a pair of generally tubular support members along which operating rings may be slid to desired positions. An air bag in each support member causes drive bars to simultaneously lock the rings against movement relative to the support members.

3 Claims, 4 Drawing Figures

CORRUGATOR

BACKGROUND OF THE INVENTION

A typical corrugator includes one or more pairs of operating-ring-supporting members in the form of rods or bars to support a number of operating rings which have edges to fold, score, slit, crease or otherwise operate on sheet products, such as, for instance, corrugated carton paper, whereby to provide carton forms which can be folded and interfitted to form cartons of corrugated paper. In prior machines of which I am aware, an operating ring has comprised a pair of halves which are secured together at their ends by bolts or screws. When it becomes necessary to adjust the positions of the rings longitudinally on their support members, the grip of each operating ring on its support member must be individually and separately relaxed by backing off one or more of the associated bolts or screws, the new position established, whereafter the grip of the operating ring must then be individually and separately reestablished by tightening the bolts or screws. This one-at-a-time operation is time-consuming and causes longer shut down time of the corrugator than is desired.

SUMMARY OF THE INVENTION

A main object of the present invention is to provide a corrugator in which the operating rings on a ring support member can be simultaneously secured in place, in contrast to the individual, one-at-a-time securing basis in prior machines.

A more specific object is to provide a ring support member having drive bars underlying all of the rings which are to perform operations on the sheet material, and to provide means for simultaneously actuating the drive bars to simultaneously create frictional driving engagement with the associated rings.

Another object is to provide drive bars with friction facings for greater torque capacity.

A still further object of the invention is to provide a corrugator having a ring support member as above described in which there is an elongated inflatable bag within the support member to which pressure can be supplied to cause simultaneous driving engagement between the drive bars and the operating rings.

The subject matter which I regard as my invention is particularly pointed out and specifically claimed in the concluding portions of this specification. The invention however, both in organization and method of operation, together with further advantages and objects thereof, may best be understood by reference to the following description taken in connection with the accompanying drawings, wherein like reference characters designate like elements. In the drawings:

Figure 1:
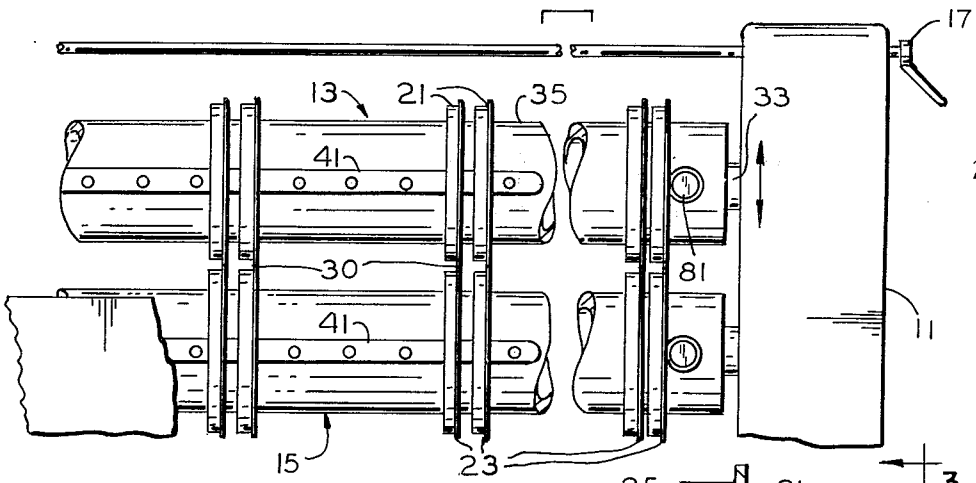
FIG. 1 is an elevational end view of a portion of a corrugator showing a pair of my ring support members.

FIG. 1 shows a portion of a corrugator machine including the concepts of the present invention. The machine includes two spaced upright hollow frame members in the form of casings, one, 11, being shown in FIG. 1. An upper elongated ring support member 13 and a lower ring support member 15 are rotatably supported at their ends in the casings, and are driven by drive means, not shown (but of conventional construction) located in the casings. The ring support members are supported in a conventional manner in the casing to permit them to be separated from one another under the control of a control member 17 to facilitate removal and/or adjustment of the operating rings.

With the machine of the present invention, the rings may be of the split type, as has been common heretofore, or may be whole (unsplit). An advantage of the split ring is that it can be removed or applied to its support member without removal of the member. With solid rings, the ring support members have to be removed from the machine to effect removal of the rings, which takes considerable time. Thus, while the machine of the present invention can use either whole rings or split rings, the rings shown are assumed to be split.

FIG. 1 shows a set of rings 21 on the upper support member 13, and a set of rings 23 on the lower support member 15. The pairs of rings which are located farthest right in FIG. 1 are extra rings not in use during the particular operation being performed. Thus the right hand end of the ring support members can be considered as storage areas.

Figure 3:
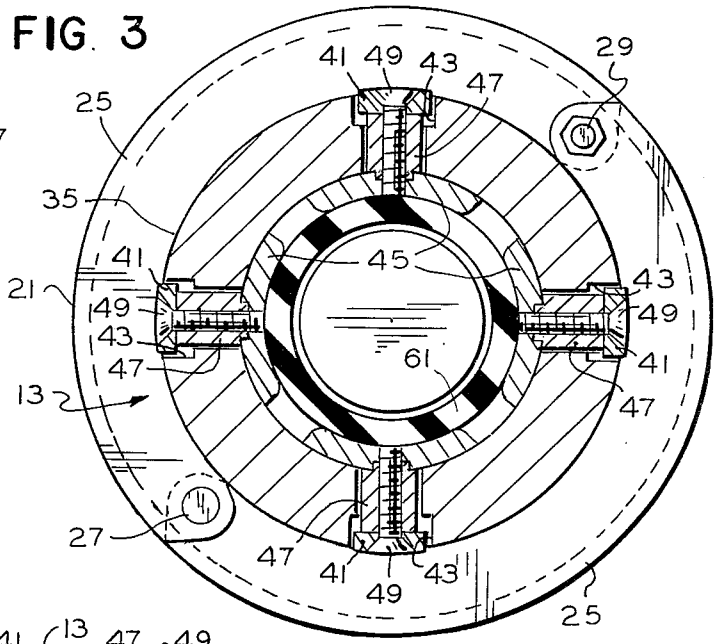
FIG. 3 is a section along line 3-3 of FIG. 2.

Referring to FIG. 3, the operating ring there shown comprises a pair of halves 25, hinged at 27 at one set of ends and secured by a bolt 29 and nut at their other set of ends. When the nut is tightened, the rings have a slip-fit (rather than a grip-fit, as has been the case heretofore) with the exterior surfaces of the associated ring support member.

The FIG. 3 ring is actually a special ring, not the split ring in common use. The latter has each pair of ends of its halves secured together by a draw bolt, disposed at right angles to bolt 29 or hinge 27. Either type of ring, or a solid ring can be used as desired. If the common ring is used, its bolts will be set so as to provide a slip fit between the rings and operating members (rather than a grip fit), when the drive bars (to be presently described) are inoperative.

It may be assumed that in FIG. 1 the rings have been slid along the ring support members to the desired position so as to be properly located for performing the desired mechanical operation on sheet material (not shown) to be fed by conveyor means (not shown, but of conventional construction) which feeds the sheet material through an operating zone between the nips of the operating edges 30 of the operating rings.

The ring support members may be of identical construction so that the details of one will suffice. FIG. 3 shows the left hand end of a ring support member 13. The member is cylindrical and of generally tubular construction and includes a pair of stub shafts 31 (FIG. 2) and 33 (FIG. 1) which are formed with journals for rotary support within the adjacent casings. The stub shafts 31 and 33 are secured in the ends of a rigid hollow tubular element 35 by screws 37.

Plural ring driving bars or braking bars 41, four being shown, are each located in a separate lengthwise groove 43 formed in the exterior cylindrical supporting surface of the tubular element 35.

The thickness of the bars is such that when they are at rest within the grooves, their outer faces are flush with or preferably countersunk into the main peripheral surfaces of the element 35, that is, the bars are below the main peripheral surface of the element 35.

Figure 2:
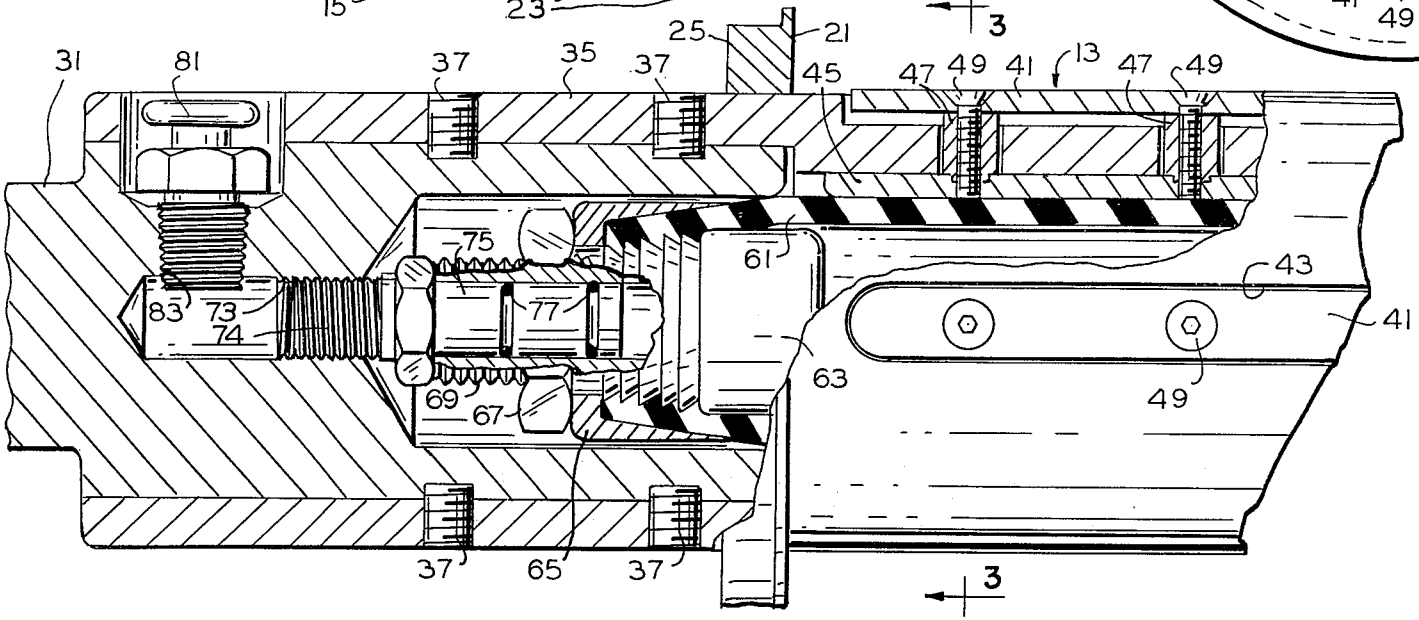
FIG. 2 is an enlarged, fragmentary partly midsectional view of an end portion of one of the ring support members.
Figure 4:
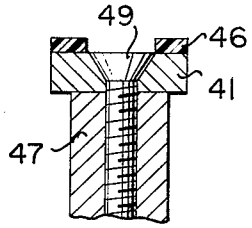
FIG. 4 is an enlarged fragmentary side elevation view of an end portion of one of the ring driving bars shown in FIG. 3.

Such faces may be friction facings, such as being coated with a suitable material, such as polyurethane. FIG. 4 shows a bar having such a friction facing 46. Referring to FIG. 2, braking bar 41, spacers 47, screws 49 and leaf 45 together comprise a pressure bar means used in the preferred embodiment.

Each bar is supported on its own exterior leaf 45, by means of spacers 47 through which screws 49 pass and thread into the leaf. The spacers are accommodated by openings formed in the bottom walls of the grooves of the tubular element 35. The leaves 45 are of arcuate cross sectional configuration, as shown in FIG. 3, to conform to the interior surfaces of the tubular element 35 and also to conform to the exterior surface of an elongate inflatable tubular bag 61 disposed within the hollow interior of the tubular element. Air bag 61 comprises a pneumatic operating means used in the preferred embodiment.

Preferably each of the bar units is spring biased inwardly so that when air is released from the bag, the bar units are automatically retracted to positions where the faces of the bars are below the periphery of the tubular element 35, so that they offer no resistance to axial shifting of the rings. Spring biasing can be provided by leaf springs (not shown) mounted on the outer faces of the interior leaves 45.

The bag 61 is sealingly secured at its ends to the stub shafts 31 and 33, as shown in FIG. 2. The securing means includes a female tube fitting 63 disposed within the associated end of the bag 61, and also includes an end cap 65 on the exterior of such tubular end. An end cap nut 67, which threads on a nipple portion 69 of the female fitting, forces the end cap axially to cause the inner tapered surface of the end cap to clamp the bag against the exterior tapered surface of the female tube fitting.

A male fitting 71 threads into a bore 73 formed in the associated stub shaft, and has a plain end 75 slidably fitting within the nipple portion 69. The plain end has O-ring seals 77.

A push-button check valve 81 threads into a reduced inner portion of a radial bore 83. The check valve enables air to be supplied to the inflatable bag, such air being retained under pressure within the operating member by the check valve after the air pressure hose (used to fill the bag) is removed.

Instead of a check valve, air can be supplied by an axial rotary union at the left hand end of the ring support member.

It will be assumed that air under pressure has been released from the inflatable bag so that the drive bars offer no resistance to axial sliding movement of the operating rings. Such rings can now be slid along the ring support members to the desired positions of alignment, such as the longitudinal positions along the ring support members shown in FIG. 1, to perform the desired job on sheet materials to be fed between the operating rings on the ring support members. It is pointed out that the slip-fit of the rings on the ring support members functions to center them accurately, therefore enabling accurate spacing between the opposed operating edges of the operating rings. Thus, it is the main surface of the ring support members largely that performs the centering function, not the pressure bars. The primary function of the pressure bars is to establish a driving relationship between the ring support members and the operating rings and to hold the rings against axial shifting movement.

Now, the rings located in the desired position, the nozzle of a pressure hose can be pressed against the check valve of each of the ring support members to open the same and facilitate the supply of air under pressure to the air bag, whereby to drive out the pressure bars into frictional driving engagement with the overlying rings to prevent not only axial slipping movement of the rings, but also to prevent circumferential slipping whereby to enable the operating rings to perform their job on the sheet material fed between the rings. Inflation of the air bag thus functions to simultaneously establish such a driving relationship between the bars and the rings and to simultaneously preclude end movement of said rings in contrast to the previous procedure wherein each of the rings had to be individually fixed in place.

I claim:

1. A support apparatus for use in a machine performing mechanical operations on sheet material fed through an operating zone of the machine, said support apparatus comprising a rigid hollow cylindrical support member mounted for rotation in said operating zone in proximity to the sheet material fed through said zone, wherein said support member has an exterior cylindrical supporting surface, a plurality of operating rings on said cylindrical support member each of which has a sliding fit with said cylindrical supporting surface and has an operating edge for performing mechanical operations on sheet material fed therepast;

said sliding fit enabling said rings to be slid along said cylindrical supporting surface to desired longitudinal positions with respect to the sheet material and to be rotated relative to said support member, a plurality of pressure bar means mounted for movement to a locking position for simultaneously locking said rings against movement with respect to said support member to hold said rings so that the operating edges of said rings can cooperate with the operating edges of rings on an adjacent support apparatus to perform the desired mechanical operations on sheet material fed through the operating zone of the machine and for movement to a release position so that said rings are free to both rotate relative to said support member and slide along said cylindrical supporting surface;

each of said pressure bar means comprising a braking bar which underlies a number of said rings and which is disposed in a separate lengthwise groove formed in said cylindrical supporting surface;

and pneumatic operating means for engaging said pressure bar means for causing outward movement of said braking bars into engagement with said rings to hold them in position;

said pneumatic operating means comprising a single inflatable bag disposed within said cylindrical support member and located beneath each of said pressure bar means, wherein said air bag is adapted to receive air under pressure to inflate the bag to expand the same and cause outward movement of said braking bars into engagement with the overlying rings, each of said braking bars having an operating face which is faced with a friction material, each of said pressure bars means also including a leaf supported by said air bag and a plurality of spacers the spacers for each leaf being each connected at one end to said leaf and extending outwardly through an opening which communicates between the hollow interior of said support member and the bottom of the associated groove and is connected at the other end to the associated braking bar.

2. A support apparatus for use in a machine performing mechanical operations on sheet material fed through an operating zone of the machine, said support apparatus comprising a rigid hollow cylindrical support member mounted for rotation in said operating zone in proximity to the sheet material fed through said zone, wherein said support member has an exterior cylindrical supporting surface;

a plurality of operating rings on said cylindrical support member each of which has a sliding fit with said cylindrical supporting surface and has an operating edge of performing mechanical operations on sheet material fed therepast;

said sliding fit enabling said rings to be slid along said cylindrical supporting surface to desired longitudinal positions with respect to the sheet material and to be rotated relative to said support member;

a plurality of pressure bar means mounted for movement to a locking position for simultaneously locking said rings against movement with respect to said support member to hold said rings so that the operating edges of said rings can cooperate with the operating edges of rings on an adjacent support apparatus to perform the desired mechanical operation on sheet material fed through the operating zone of the machine and for movement to release position so that said rings are free to both rotate relative to said support member and slide along said cylindrical supporting surface;

each of said pressure bar means comprising a braking bar which underlies a number of said rings and which is disposed in a separate lengthwise groove formed in said cylindrical supporting surface;

and pneumatic operating means for engaging said pressure bar means for causing outward movement of said braking bars into engagement with said rings to hold them in position;

said pneumatic operating means comprising a single inflatable bag disposed within said cylindrical support member and located beneath each of said pressure bar means;

wherein said air bag is adapted to receive air under pressure to inflate the bag to expand the same and cause outward movement of said braking bars into engagement with the overlying rings;

each of said braking bars having an operating face which is faced with a friction material;

the operating face of each of said braking bars being countersunk into the cylindrical supporting surface when said pressure bar means are moved to the release positions.

3. A corrugator support apparatus for supporting rings for performing mechanical operations on sheet material fed between said support apparatus and an adjacent support apparatus, said corrugator support apparatus comprising;

a rigid hollow elongate cylindrical support member, wherein said support member has a cylindrical exterior support surface for supporting and centering rings slid onto the support surface;

a plurality of pressure bar means, said pressure bar means each comprise a braking bar which is countersunk in a separate lengthwise groove formed in the support surface when the bar is at rest in the groove;

and means for moving said pressure bar means outwardly to move said braking bars into simultaneous engagement with the rings which have been slid onto the support member to hold the rings in position;

said last named means comprising a single inflatable air bag located within said support member and located beneath each of said pressure bar means, said air bag being adapted to receive air under pressure to inflate the bag to expand the same and cause the braking bars to move outwardly into engagement with the rings;

each of said braking bars having an operating face which is faced with a friction material;

said braking bars simultaneously locking said rings against movement with respect to said ring support surface;

said bars being spaced substantially equal distances around said support member;

each of said pressure bar means also including a leaf supported by said air bag and a plurality of spacers, the spacers for each leaf being connected at one end to said leaf and extending outwardly through an opening which communicates between the hollow interior of said support member and the bottom of the associated groove and is connected at the other end to the associated braking bar.

* * * * *